United States Patent [19]

Stumpp et al.

[11] 4,273,091

[45] Jun. 16, 1981

[54] FUEL INJECTION PUMP FOR INTERNAL COMBUSTION ENGINES

[75] Inventors: Gerhard Stumpp, Stuttgart; Max Greiner, Gerlingen; Otmar Weiss, Stuttgart; Karl Konrath, Ludwigsburg, all of Fed. Rep. of Germany

[73] Assignee: Robert Bosch GmbH, Stuttgart, Fed. Rep. of Germany

[21] Appl. No.: 59,353

[22] Filed: Jul. 20, 1979

[30] Foreign Application Priority Data

Sep. 28, 1978 [DE] Fed. Rep. of Germany ..... 2842155

[51] Int. Cl.[3] ..... F02M 59/02; F04B 39/10

[52] U.S. Cl. ..... 123/506; 251/362; 277/DIG. 6; 277/236; 417/499

[58] Field of Search ..... 123/506, 495; 137/454.5; 251/362; 277/110, 111, 236, DIG. 6; 417/490, 499; 285/DIG. 18

[56] References Cited

U.S. PATENT DOCUMENTS

| | | | |
|---|---|---|---|
| 1,336,738 | 4/1920 | Fletcher | 277/236 |
| 2,513,883 | 7/1950 | Male | 417/499 |
| 2,670,684 | 3/1954 | Fagerholt | 417/499 |
| 3,792,834 | 2/1974 | Billeter | 277/110 |
| 3,918,485 | 11/1975 | Weber | 277/236 |
| 3,971,566 | 7/1976 | Levinsohn | 277/236 |
| 4,066,269 | 1/1978 | Linne | 277/DIG. 6 |
| 4,074,908 | 2/1978 | Spencer | 277/DIG. 6 |

*Primary Examiner*—Charles J. Myhre
*Assistant Examiner*—Carl Stuart Miller
*Attorney, Agent, or Firm*—Edwin E. Greigg

[57] ABSTRACT

A fuel injection pump for internal combustion engines is proposed in which cavitation is avoided at the sealing surface between a threaded connection element which contains the pressure valve and a securing flange of the pressure valve housing which protrudes radially outwardly therefrom. The securing flange is attached to a cylindrical portion on the end of the valve housing remote from the pressure line leading to the injection nozzle and a sealing member is fitted into an intermediate chamber between the cylindrical portion and an inner wall of the threaded connection element. This sealing member is pressed with at least one annular contact surface onto the cylindrical housing portion and with a different contact surface, axially displaced with respect to the first, is pressed against the threaded connection element. The sealing member may be embodied as a thin-walled sheet-metal sleeve, may comprise a spiral spring, or may be made of plastic.

7 Claims, 4 Drawing Figures

FUEL INJECTION PUMP FOR INTERNAL COMBUSTION ENGINES

BACKGROUND OF THE INVENTION

The invention relates to a fuel injection pump as described hereinafter and finally claimed. Fuel injection pumps of this type are known from the German Pat. No. 840,334 or Swiss Pat. No. 192,773. In the pressure valves used in these pumps, cavitation damage occurs, at certain injection pressures and with certain combinations of dimensions of the pressure lines and pressure valves required for adaptation to engine conditions, and particularly at the sealing location between the end face of the hollow-cylindrical threaded connection element and the securing flange on the valve housing, as a result of the pressure fluctuations which appear in the pressure line leading to the injection nozzle. This damage is brought about by the underpressures occurring during the zero-pressure passages of the pressure fluctuations and the thereby effected formation of hollow spaces or vapor bubbles in the fuel. The damage is so extensive that the sealing surface between the threaded connection element and the pressure valve housing is destroyed and thus there is no longer any seal.

OBJECT AND SUMMARY OF THE INVENTION

The fuel injection pump in accordance with the invention has the advantage over the prior art that the underpressure waves do not reach the sealing surface, but rather are damped by the sealing member as they travel toward the sealing surface to such an extent that no cavitation damage can any longer be ascertained. Furthermore, the manner of securing the sealing member serves advantageously in centering the valve housing within the threaded connection element.

By means of the features described in the dependent claims, advantageous further embodiments and improvements of the sealing member described in claim 1 are possible. A sealing member which is easy to manufacture is described in claim 3, and the characteristics of claim 4 result in simple assembly and short access distances. Good shielding and damping of the pressure waves can be attained along the cylindrical housing portion of the pressure valve up to the sealing surface between the threaded connection element and the securing flange as a result of the characteristics of claim 5 and when the protective sleeve is made of plastic according to claim 6, then not only the shape of the sealing member but its material substance as well contribute to reinforced damping of the pressure waves and shielding of the vulnerable sealing location. If the length of the sealing member is at least approximately identical to that of the cylindrical housing portion, then it is possible to obtain, in an advantageous manner, both an optimum length for the shielded distance and an effective protection against cavitation.

The invention will be better understood as well as further objects and advantages thereof become more apparent from the ensuing detailed description of preferred embodiments taken in conjunction with the drawings.

DESCRIPTION OF THE PREFERRED EMBODIMENTS

Figure 1:
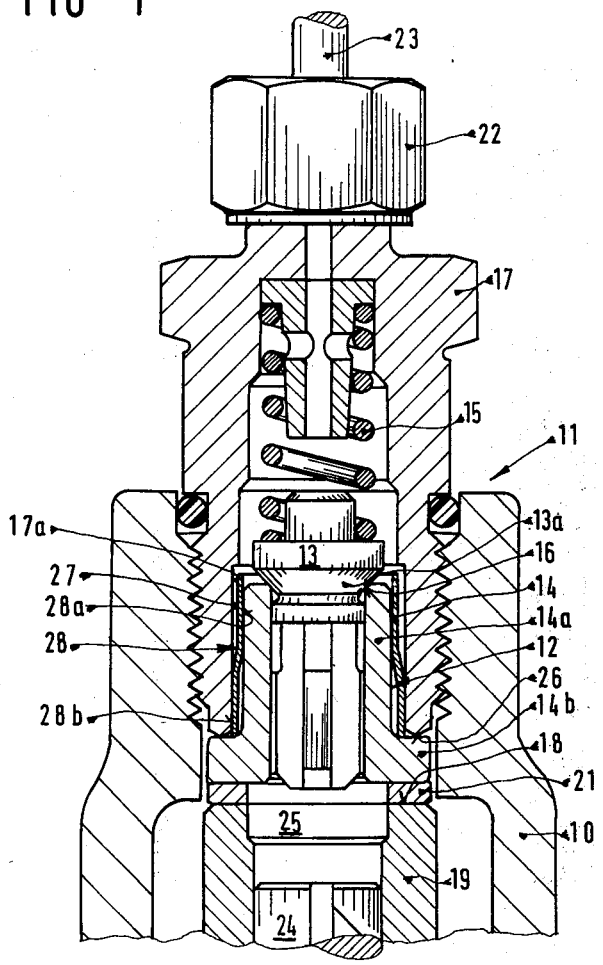
FIG. 1 is a partial longitudinal cross-sectional view through the first exemplary embodiment of the invention.

Turning now to the drawings, in the first exemplary embodiment of FIG. 1 a pressure valve 12 is installed in a housing 10 of a fuel injection pump 11. In this embodiment the valve comprises, in the illustrated position, a constant-pressure relief valve and its movable valve member 13, which is guided within a valve housing 14 and under the force of a valve spring 15 closes a valve seat 16 with a conically-shaped closing portion 13*a*.

The pressure valve 12, which is flooded on the inside with fuel, is pressed in a known manner against a shoulder 18 inside the injection pump 11 by means of an elongated threaded connection element 17 with the shoulder in the present embodiment being formed by an end face 18 of a pump cylinder 19 which is secured in the housing 10. It will be noted that a metallic sealing ring 21 is positioned between the valve housing 14 and the pump cylinder 19. The shoulder 18 can, of course, also be embodied by a step in a bore in the pump housing or inside the pump cylinder. Attached to the threaded connection element 17, by means of a coupling nut 22, is a fuel pressure line 23 which leads to the injection nozzle. The pressure valve 12 controls the connection from the pump working chamber 25, located above a pump piston 24 within the pump cylinder 19, to the pressure line 23 and thus to the injection nozzle (not shown).

The pressure valve 12 is designed as a "necked valve" and its valve housing 14 has a securing flange 14*b* which protrudes radially outwardly on the end remote from the pressure line 23 and attached to a cylindrical portion 14*a* of the housing. The flange 14*b* is pressed against the shoulder 18 by a projection on an end face 26 of the hollow-cylindrical pipe connection piece 17. The end face 26, with the securing flange 14*b*, forms a seal means, however, the invention is also intended to include arrangements in which a sealing ring is also disposed at this location.

Between an inner wall 17*a* of the threaded connection element 17 and the cylindrical housing portion 14*a* of the valve housing 14, there is provided an annular intermediate chamber 27 into which a protective sleeve 28 is positioned in accordance with the invention. This protective sleeve,embodied as a thin-walled sheet-metal sleeve, is preferably produced of sheet metal having a thickness of 0.3 mm and pressed with an annular contact surface 28*a* against the cylindrical portion 14*a* of the valve housing and also provided with a second annular contact surface 28*b*, which is capable of being axially displaced with respect to the first and thus pressed against the threaded connection element 17 contacting its inner wall 17*a*, all of which is clearly shown in FIG. 1. As may be also clearly seen in FIG. 1, the contact surface 28*a* of the protective sleeve 28 which is pressed against the cylindrical housing portion 14*a* is disposed on the end section of the protective sleeve which is oriented toward the pressure line 23, and the other contact surface 28*b* which is pressed against the threaded connection element 17 is disposed on the end section which is oriented toward the pump working chamber 25. This results not only in a satisfactory and virtually fluid-tight bridge in the intermediate chamber 27 between the valve housing 14 and the threaded connection element 17, but also in a centering of the pressure valve within the threaded connection element which is both elastic and simple in function. This arrangement of elements also achieves a partial filling of the intermediate chamber 27 in such a manner that under-pressure waves which arise in the pressure line 23 and thereby cause cavitation at the sealing surface between the end face 26 of the threaded connection element 17 and the securing flange 14*b* cannot penetrate to the sealing surface, but rather die out in the gap formed between the protective sleeve 28 and the threaded connection element 17 or valve housing 14. This effect also appears even when the contact surfaces between the protective sleeve 28 and the valve housing portion 14*a* or the threaded connection element 17 is provided with thin slits in the metal so long as a tight seal is achieved between the respective elements.

Experiments have demonstrated satisfactory shielding of the sealing location. Because of the protective sleeve, the inner wall 17*a* of the threaded connection element and the outer diameter of the cylindrical portion 14*a* do not need to be finely finished in order to fit one another exactly, which would be necessary if the gap preventing the underpressure waves from reaching the sealing location had to be obtained by means of microfinishing or lapping in of the respective elements. Such fine finishing additionally has the further disadvantage that the associated cylindrical surfaces must be finished to be precisely perpendicular to the end face 26 on the threaded connection element 17 and to the opposite end face, not described in detail, of the securing flange 14*b*.

In order to prevent transverse shifting during the clamping of the threaded connection element 17, all the bores would also have to be correlated to extend very precisely in axial alignment relative to one another. Such fine finishing is avoided by means of the protective sleeve 28 of the invention, which achieves a substantial reduction in the cost of mass production of the pressure valve threading and securing means.

Figure 2:
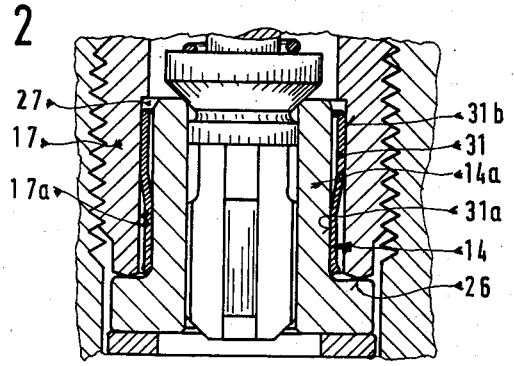
FIG. 2 shows a fragmentary view of the critical area of the structure with the sealing member rotated 180°.

In the second exemplary embodiment of the invention, shown in FIG. 2, the protective sleeve 31 corresponds substantially in shape to the protective sleeve 28 of FIG. 1 but it is rotated 180° before installation, and its annular contact surface 31*a* is pressed against the cylindrical housing portion 14*a* of the valve housing 14 and is thus constricted inwardly, whereby the lower end section of the protective sleeve 31 is oriented toward the pump working chamber 25. On the other hand, the annular contact surface 31*b* is arranged to contact the inner wall 17*a* of the threaded connection element 17 and being pressed in at that location it is disposed in a manner that is oriented toward the pressure line 23. This disposition has the disadvantage of greater insertion depths both inside the threaded connection element 17 and on the valve housing 14 as well; however, it does have the distinct advantage that the part of the protective sleeve 31 which contains the contact surface 31*a* has a greater distance from the sealing surface acted upon by the end face 26 of the threaded connection element 17. All the other structural parts in this embodiment correspond to those described in connection with that shown in FIG. 1.

Figure 3:
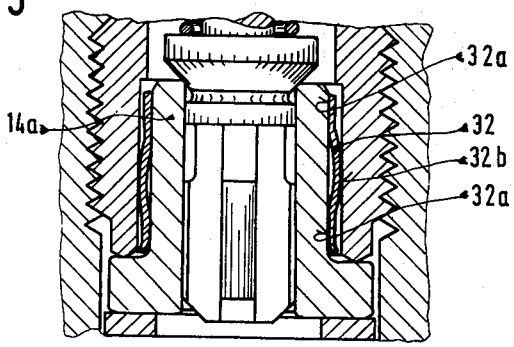
FIG. 3 shows a further fragmentary cross-sectional view of the critical area of the structure with the sealing member provided with a central bulged area.

In the third exemplary embodiment of FIG. 3, the protective sleeve 32 has two annular contact surfaces 32*a* on its two end sections disposed symmetrically with respect to one another and these are pressed against the cylindrical portion 14*a* of the valve housing 14, while the annular contact surface 32*b* is bulged outwardly in the middle portion thereof so as to engage the inner circumferential wall of element 17. This embodiment of the protective sleeve has the advantage over the protective sleeves 28 and 31 of FIGS. 1 and 2 that it is completely symmetrical and thus can never be installed with the wrong end up.

Figure 4:
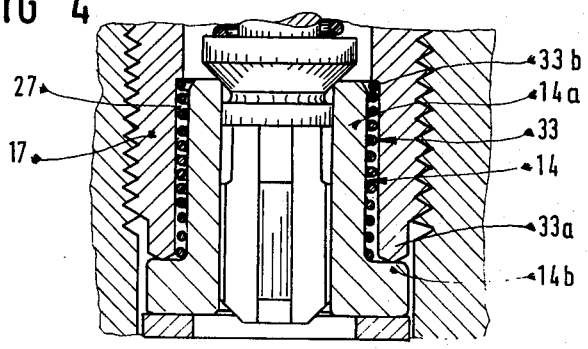
FIG. 4 shows a still further fragmentary cross-sectional view of the critical area of the structure with the sealing member comprising a coiled spring.

In the fourth exemplary embodiment shown in FIG. 4, a protective sleeve 33, which comprises a relatively tightly wound spiral spring, is inserted into the intermediate chamber 27 between the threaded connection element 17 and the valve housing 14. In this device at least one coil 33*a* rests near the securing flange 14*b* on the cylindrical portion 14*a* of the valve housing 14 and at least one coil 33*b* is firmly pressed against the inner wall 17*a* of the threaded connection element 17. As a result of this protective sleeve 33 which is embodied as a spiral spring, a labyrinthine sealing operation is brought about in the intermediate chamber 27, so that the harmful underpressure waves which cause cavitation cannot make their way forward to the sealing surface between the threaded connection element 17 and the securing flange 14*b* or at least are so extensively damped that they have no further harmful capacity.

The protective sleeves 28, 31 and 32 shown in FIGS. 1–3 may also be produced out of plastic, with an appropriately adapted wall thickness and shape, which accordingly reduces the expense of their manufacture.

The foregoing relates to preferred embodiments of the invention, it being understood that other embodiments and variants thereof are possible within the spirit and scope of the invention, the latter being defined by the appended claims.

What is claimed and desired to be secured by Letters Patent of the United States is:

1. A fuel injection pump for internal combustion engines, particularly Diesel engines having a pressure valve disposed between the pump working chamber and the pressure line leading to the injection nozzle, said pressure valve including a flange on its lower terminal end remote from said pressure line, said pressure valve arranged to be pressed by the end face of a hollow-cylindrical threaded connection element having an inner disposed wall downwardly toward a pump cylinder, and an annular chamber disposed between said inner wall of the threaded connection element and said pressure valve, further wherein a protective sealing means is positioned in said chamber, said sealing means further including at least two annular contact surfaces axially displaced relative to one another and one each of which contact surfaces is arranged to engage said pressure valve and said inner wall of said threaded connection element.

2. A fuel injection pump in accordance with claim 1, further wherein said protective sealing means comprises a thin-walled sheet-metal sleeve and said pressure valve includes a cylindrical housing portion.

3. A fuel injection pump in accordance with claim 2, further wherein said thin-walled sheet-metal sleeve includes contact surfaces, at least one of said surfaces being pressed against said cylindrical housing portion and another of said contact surfaces being pressed against said threaded connection element.

4. A fuel injection pump in accordance with claim 3, further wherein said one contact surface pressed against said cylindrical housing portion is oriented toward said pressure line and said other contact surface pressed against said threaded connection element is disposed toward said pump working chamber.

5. A fuel injection pump in accordance with claim 2, further wherein said sealing means comprises a spiral spring, at least one coil of which rests on the cylindrical housing portion and another coil thereof rests on the inner wall of said threaded connection element.

6. A fuel injection pump in accordance with claim 1, further wherein said sealing means comprises a plastic member.

7. A fuel injection pump in accordance with claim 2, further wherein said sealing means is substantially the length of said cylindrical housing portion.

* * * * *